US005616540A

United States Patent [19]

Lithgow et al.

[11] Patent Number: 5,616,540

[45] Date of Patent: Apr. 1, 1997

[54] ELECTROMAGNETIC RESONANT FILTER COMPRISING CYLINDRICALLY CURVED SPLIT RING RESONATORS

[75] Inventors: Robert D. Lithgow, Schaumburg; James M. Peters, Evanston, both of Ill.

[73] Assignee: Illinois Superconductor Corporation, Evanston, Ill.

[21] Appl. No.: 349,060

[22] Filed: Dec. 2, 1994

[51] Int. Cl.[6] ..... H01P 1/201; H01P 7/00; H01B 12/06

[52] U.S. Cl. ..... 505/210; 333/202; 333/219; 333/99 S; 505/700; 505/866

[58] Field of Search ..... 333/99 S, 202, 333/212, 219, 235; 505/210, 700, 866

[56] References Cited

U.S. PATENT DOCUMENTS

| | | | |
|---|---|---|---|
| 4,446,429 | 5/1984 | Froncisz et al. | 333/235 X |
| 4,504,788 | 3/1985 | Froncisz et al. | 333/235 X |
| 4,728,779 | 2/1988 | Hyde et al. | 333/219 X |
| 4,841,249 | 6/1989 | Duerr et al. | 333/219 X |
| 5,011,823 | 4/1991 | Jin et al. | 505/452 |
| 5,051,704 | 9/1991 | Bentivenga et al. | 333/227 |
| 5,157,017 | 10/1992 | Jin et al. | 505/451 |
| 5,272,132 | 12/1993 | Gyorgy et al. | 505/430 |
| 5,324,713 | 6/1994 | Shen | 505/210 |
| 5,340,797 | 8/1994 | Hodge et al. | 505/470 |

FOREIGN PATENT DOCUMENTS

| | | | |
|---|---|---|---|
| 2123823 | 11/1971 | Germany | 333/219.1 |
| WO88/08622 | 11/1988 | WIPO . | |

OTHER PUBLICATIONS

W.N. Hardy and L.A. Whitehead, "Split–ring resonator for use in magnetic resonance from 200–2000 MHz," Rev. Sci, Instrum. 52(2), Feb. 1981.

Patricia Jezek, Hai Tran, and T. Koryu Ishii, "Strip–ring resonator makes harmonics–rich oscillator," Microwaves & RF, Jun. 1984.

J.R. Delayen, G.J. Dick and J.E. Mercereau, "Test of A β~0.1 Superconducting Split Ring Resonator," IEEE, 17(1), Jan. 1981.

Mehrdad Mehdizadeh, T. Koryu Ishii, James S. Hyde and Wojciech Froncisz, "Loop–Gap Resonator: A Lumped Mode Microwave Resonant Structure," *IEEE Trans. Microwave Theory Tech.*, vol. MTT–31, pp. 1059–1063, Dec. 1983.

Anatol I. Zverev, *Handbook of Filter Synthesis,* (wiley, New York, 1967).

Dick et al., "The Superconducting Split Ring Resonator As An Accelerating Strucutre", *Nuclear Instruments and Methods* 138:203–207 (1976).

Wang et al., "Radio–frequency losses of $YBa_2Cu_3O_{7-\delta}$ composite superconductors", *Supercond. Sci. Technol.* 1:24–26 (1988).

*Primary Examiner*—Benny T. Lee
*Attorney, Agent, or Firm*—Marshall, O'Toole, Gerstein, Murray & Borun

[57] ABSTRACT

A filter for processing electromagnetic signals has a housing with resonators located inside the cavity of that housing. The resonators, which may be made in part from superconducting material, have rounded exterior surfaces without corners to provide a more desirable coating surface and uniform electric field around the resonators. The filter housing may be composed of a plurality of housing cells, each containing a resonator. These cells can be removably attached to other cells so that resonators may be added to or removed from the filter as may be required for a particular application.

25 Claims, 5 Drawing Sheets

FIG. 1
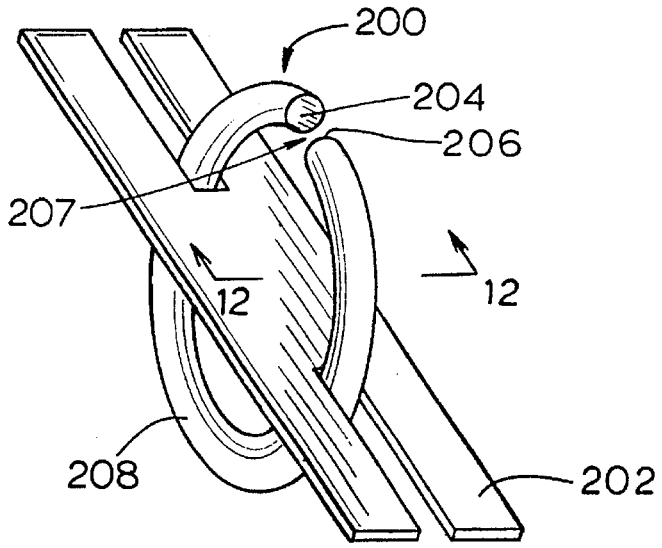
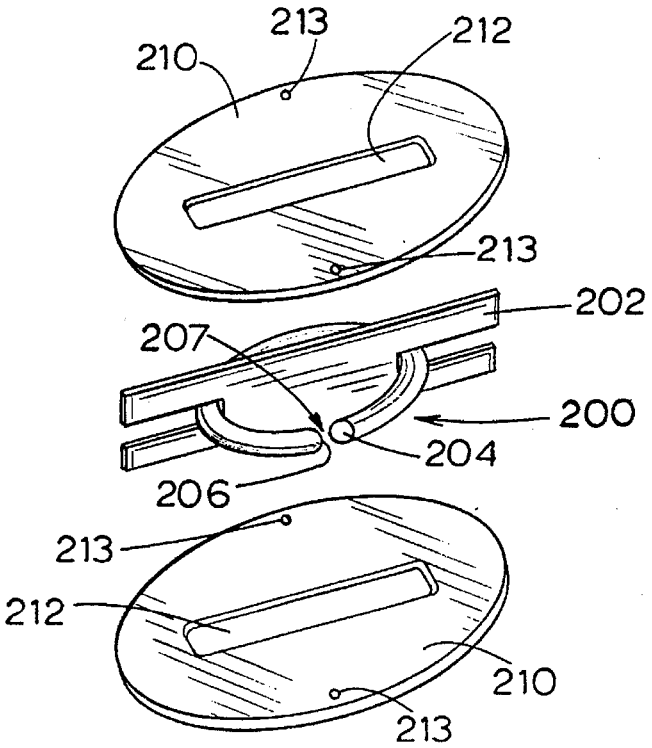
FIG. 2

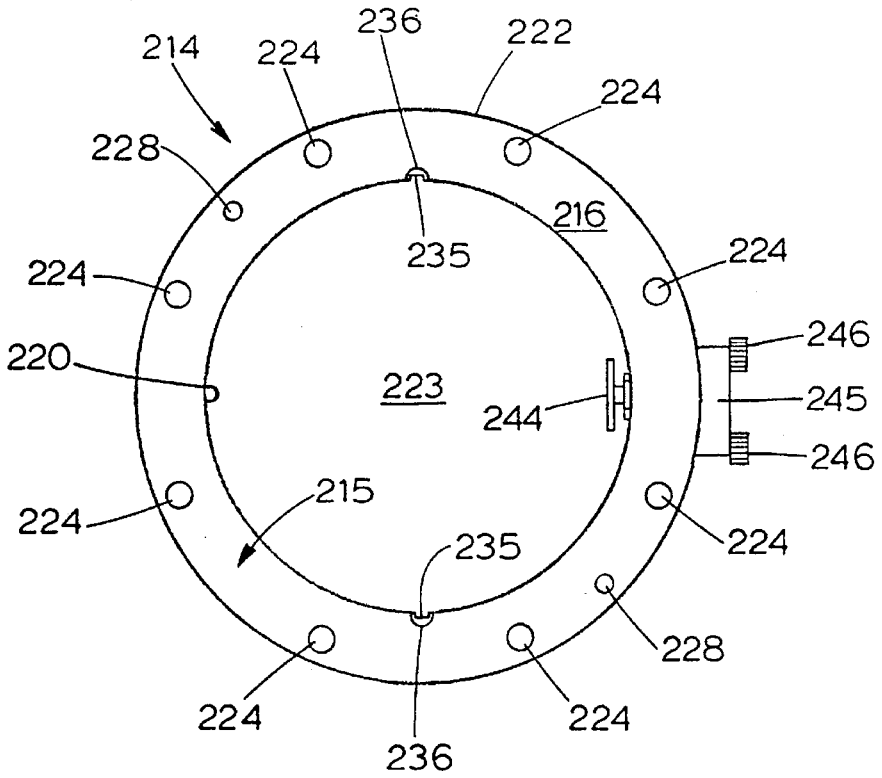
FIG. 3
FIG. 4
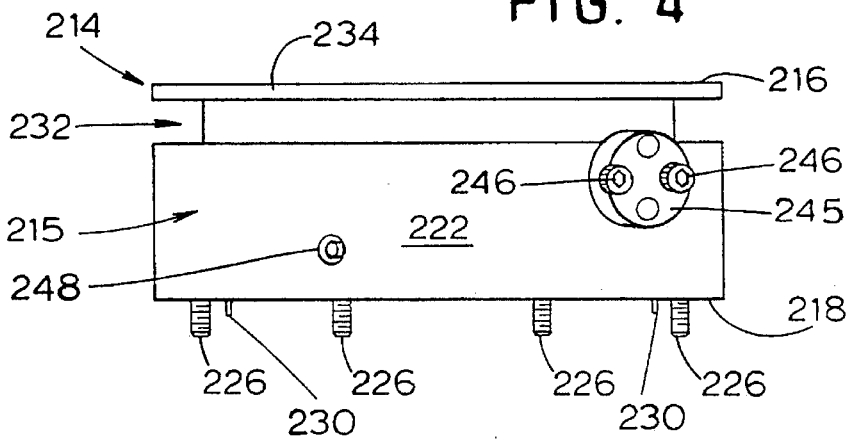
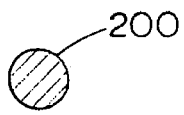
FIG. 12
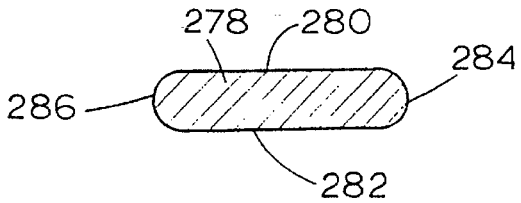
FIG. 13

ELECTROMAGNETIC RESONANT FILTER COMPRISING CYLINDRICALLY CURVED SPLIT RING RESONATORS

This invention was made in part with government support under a cooperative agreement number 70NANB3H1381 awarded by the Department of Commerce.

BACKGROUND OF THE INVENTION

1. Field of Invention

This invention relates generally to resonant cavity filters and more particularly to modular housings for filters having resonators as well as to the shape of those resonators.

2. Background Art

Conventional resonant cavity electromagnetic filters consist of an outer housing made of an electrically conductive material. One or more resonators is mounted inside the housing by use of a dielectric material. Electromagnetic energy is coupled through a first coupling in the housing to a first resonator, to any additional resonators in the housing and then out of the housing through a second coupling. The particular design, shape, materials and spacing of the housing and resonator will determine the signal frequencies passed through the filter, as well as the insertion loss or quality ("Q") of the filter. Many filter housings are designed with solid walls and are therefore suitable only for a preset number of resonators. If a particular application requires greater or fewer resonators than the preset number, an entirely new housing must be constructed to accommodate the desired number of resonators.

A type of resonator that may be used in filters is the split ring, consisting of a rectangular plate bent to form a hollow cylinder with a gap running from the top to the bottom of the cylinder at the ends of the bent plate. Thus while the sides of the cylinder or ring will be curved, the top and bottom will be flat and meet the cylinder sides at a right angle. Right angles or corners on the cylinder are undesirable for two reasons. First, the corners create discontinuities in the electric field around the resonator in the area of those corners. Second, resonators are generally made of a conductive material, but also may be coated with a superconducting material. Coating the corners of a resonator is difficult and may lead to non-uniform coating and additional discontinuities in the electric field around the resonator.

When the resonator contains superconducting material, additional problems are encountered because of the need to cool that material to cryogenic temperatures to achieve superconducting properties. The filter housing, resonator and dielectric material used to mount the resonator may all have differing coefficients of thermal expansion and are exposed to a very wide temperature range during cool down and warm up. Provision for expansion and contraction of the materials of such filters should therefore be made to ensure that all elements of the filter are properly situated when immersed in liquid nitrogen, or other super-cooling fluid or when attached to a cryogenic cooler. It is also important to ensure that the resonator is cooled sufficiently by the liquid nitrogen or other cryogenic cooling methods which will be located outside of the housing.

SUMMARY OF THE INVENTION

There is provided in accordance with the present invention a filter having a housing with a cavity in the housing containing a split ring resonator. The resonator has an outer surface and a first face and a second face where the outer surface is rounded and the first and second faces oppose each other to form a gap.

The resonator may have a circular cross-section or may have an oblong cross-section. The resonator may be made from a superconducting material, including a film of $YBa_2Cu_3O_7$.

The filter may have a substrate for holding the resonator and there may be a groove on the inner surface of the housing for insertion of the substrate. A pin may be placed at a first end of the groove for locating the substrate and a spring may be placed at the other end of the groove for retaining the substrate while allowing for movement of the substrate with respect to the groove due to expansion or contraction of the housing and substrate.

A thermally conductive gas can be placed in the cavity to transmit heat from the resonator to the housing to aid in cooling of the resonator when the housing is placed in a cryogenic environment. A substrate made of a dielectric material for holding the resonator may be placed in the housing and the housing may be made of aluminum coated with silver.

The filter may have a plurality of housing cells with each cell containing a resonator and the filter may have means for coupling electromagnetic energy from each resonator to an adjacent resonator. Each cell may have a cell wall with an upper surface and a lower surface and include means adjacent the upper surface and lower surface for releasably attaching the cell to adjacent cells or to end plates.

A first end cell and a second end cell may be provided with a first end plate fastened to the upper surface of the first end cell and a second end plate fastened to the lower surface of the second end cell. The first end cell may contain means for coupling electromagnetic energy through the housing to a resonator and the second end cell may contain means for coupling electromagnetic energy from a resonator to the housing.

The means for coupling electromagnetic energy from each resonator to an adjacent resonator may comprise plates having apertures in the plates. The surfaces of the housing cells may have alignment pins and the plate may have alignment holes where the alignment pins engage alignment holes to fix plates in a desired position on the cells.

In accordance with another embodiment of the present invention, a modular filter may have a plurality of housing cells, each cell having means at an upper surface and a lower surface for connection to other cells. Each cell has a cavity therein and a plurality of resonators are located in the cavities of the cells. Means are provided for transmitting an electromagnetic signal through a cell wall to a resonator in that cell, for transmitting electromagnetic energy from the resonator in the first cell to a resonator in a second cell and for transmitting electromagnetic energy from the resonator in the second cell through a cell wall.

In accordance with another embodiment of the present invention, a filter has a filter housing with a wall defining a cavity. A resonator is formed from superconducting material and mounted on a substrate. A groove on an inner surface of the housing wall is provided for insertion of the substrate, with means at a first end of the groove locating the substrate in the groove. A spring means at the other end of the groove is provided for locating the substrate while allowing for movement of the substrate with respect to the groove due to thermal expansion or contraction. The housing may be cooled by a cryorefrigerator.

Other features and advantages are inherent in the filter claimed and disclosed or will become apparent to those skilled in the art from the following detailed description in conjunction with the accompanying drawing.

BRIEF DESCRIPTION OF THE DRAWING

FIG. 1 is a perspective view of a resonator and substrate used in one embodiment the filter of the present invention;

FIG. 2 is a perspective view of the resonator and substrate of FIG. 1 shown between two aperture plates;

FIG. 3 is a top view of a housing cell of a filter of the present invention;

FIG. 4 is a side elevational view of the housing cell of FIG. 3;

FIG. 12 is a cross-sectional view taken along the lines 12—12 of FIG. 1; and FIG. 13 is a cross-sectional view taken along the lines 13—13 of FIG. 10.

DETAILED DESCRIPTION OF THE INVENTION

Figure 5:
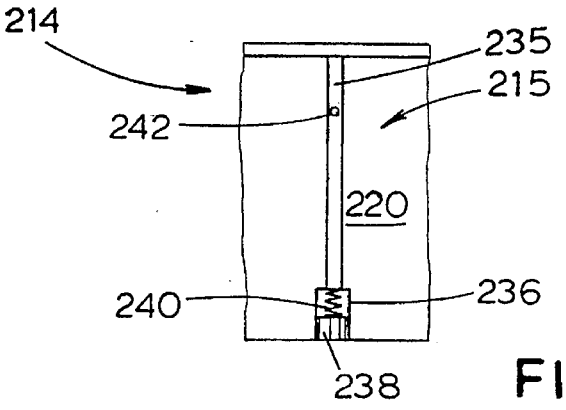
FIG. 5 is an elevational view of a groove on the interior of the housing cell of FIG. 3.

Referring initially to FIGS. 1, 2 and 12, a split ring resonator 200 is mounted on a substrate 202 and may have a small amount of adhesive (not depicted) where the resonator 200 contacts the substrate 202. The resonator 200 has a circular cross section (FIG. 12) and is formed from a cylindrical piece of metal which has been bent into a ring so that an end face 204 and an end face 206 are located adjacent but not in contact with each other to form a gap indicated generally at 207. Because of the circular cross-section of the resonator 200, its outer surface 208, consisting of all surfaces of the resonator 200 with the exception of the end face 204 and the end face 206, has no angles or corners. The resonator may be made in whole or in part of metal (e.g., copper, silver-plated brass, or aluminum) or may be formed in total or in part of a dielectric material (e.g., polymer material or ceramic such as zirconia, titanate or alumina) and conductive material (e.g., copper, silver or aluminum). The resonator 200 may be formed of or coated with a superconductive material, preferably $YBa_2Cu_3O_7$. The superconducting material may be in bulk or a thin film, but will preferably be in the form of a thick film (0.025–0.100 mm thick) and applied in accordance with the teachings of U.S. Pat. No. 5,340,797 which is incorporated herein by reference. The absence of corners or angles on the outer surface 208 of the resonator 200 allows for easy coating of the resonator 200 with a film of superconducting material. In addition, the lack of corners provides a more uniform electric field around the resonator, thus leading to superior characteristics of a filter containing such a resonator.

When placed in a filter, the resonator 200 and the substrate 202 will generally be located between coupling plates 210 (FIG. 2). Each coupling plate 210 has an aperture 212 which may be generally aligned with the substrate 202. The coupling plates 210 have alignment holes 213 which fit into pins (described below) on the housing of a filter. The coupling plates 210 are used to control the electromagnetic energy transmitted from one resonator to an adjacent resonator. Therefore, the size, shape and location of the aperture 212 are critical in providing the desired coupling between adjacent resonators. No one design of a coupling plate will be appropriate for all applications, as each filter application may require different filtering characteristics.

Referring now to FIGS. 3 through 7, an interior housing cell indicated generally at 214 has a circular wall indicated generally at 215 defined by an upper surface 216, a lower surface 218, an inner surface 220 and an outer surface 222. The inner surface 220 of the wall 215 defines a cavity 223 in the interior of the cell 214 (FIG. 3). Formed in the upper surface 216 are several bolt openings 224 and alignment openings 228. Located on the bottom surface 218 are several bolts 226 and alignment posts 230 (FIG. 4). A reduced diameter portion 232 (FIG. 4) is formed in the cell wall 215 to define an annular rim 234 adjacent the upper surface 216. The bolts 226 and the alignment posts 230 of a cell are inserted through the bolt openings 224 and the pin openings 228, respectively, of an adjacent cell. The bolts 226 then protrude through the annular rim 234 and into the portion 232 of an adjacent cell and are secured with nuts (FIG. 7) to fasten the cells together. In order to ensure a hermetic seal between cells at cryogenic temperatures, indium solder or other gasketing material may be applied between cells on the upper surface 216 and the lower surface 218.

Formed in interior surface 220 are two rectangular grooves 235 located 180° opposite each other. At one end of each groove 235 is a semi-circular detent 236. Each detent 236 is adapted to receive a ring 238 which partially contains a spring 240 as shown in FIG. 5. Adjacent the other end of the groove 235 is a pin 242 (FIG. 5). The substrate 202 is placed into each groove 235 between pin 242 and spring 240 so that the substrate 202 cannot move past the pin 242 or the spring 240. The spring 240 allows for expansion and contraction of materials in each cell so that the substrate 202 and thus the resonator 200 are kept in the desired position (FIG. 6) while undergoing the change from room temperature to cryogenic or superconducting temperatures. The thickness of the substrate 202 and the width of the groove 235 should be nearly identical to minimize any movement of the substrate 202 and thus the resonator 200 in a direction perpendicular to the length of the groove 235. A small amount of nylon tape or other flexible material placed around the ends to the substrate 202 prior to insertion into groove 235 may also minimize movement of the substrate 202 and maintain its desired alignment.

Figure 6:
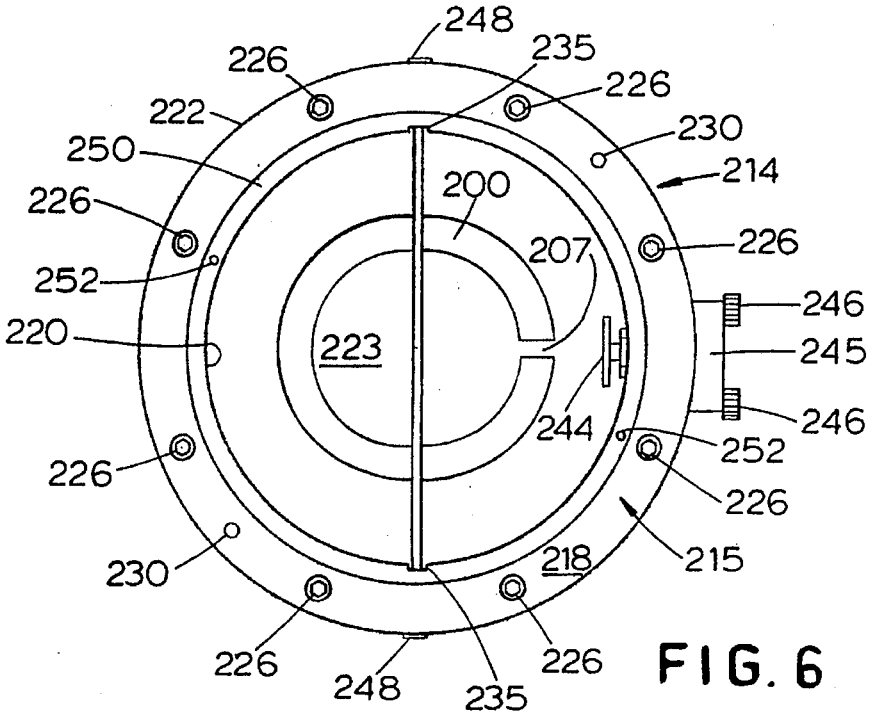
FIG. 6 is a bottom view of the housing cell of FIG. 3 containing a resonator and substrate.

Also located on interior surface 220 is a tuning disk 244 (FIG. 6). The tuning disk 244 is situated adjacent the gap 207 of the resonator 200 and can be moved closer to or farther from the gap 207 by rotation of a screw (not depicted) located in the wall 215 of the cell 214 to adjust the capacitance of the resonator. Tuning discs may be made from a disc formed of brass plated with silver and the adjustment mechanism may consist of a post and threads and may be made of brass.

On the outer surface 222 is a cap 245 having two bolts 246 (FIG. 6). The cap 245 is used to seal the cell 214 in the area where an opening has been drilled to allow placement of the tuning disk 244 and its attendant adjustment mechanism.

Also located on the outer surface 222 are two pin caps 248 located outside of the pins 242. The pin caps 248 hold the pins 242 in place and cover the holes, which have been drilled through the cell wall 215 to allow insertion of the pins 242, to seal the inside of the cell from the outside. Both the cap 245 and the pin caps 248 may be sealed to the outer surface 222 with indium solder.

In the area where the lower surface 218 meets the inner surface 220, a circular shelf 250 (FIG. 6) is formed. The outer diameter of the circular shelf 250 is approximately equal to the outer diameter of the coupling plate 210 (FIG. 2), and the distance from the top of the shelf 250 to the upper surface 216 is approximately equal to the thickness of the coupling plate 210. When a coupling plate 210 is placed onto the shelf 250, the top of the plate will be flush with the upper surface 218, and will be held onto the shelf 250 by the upper surface 216 of an adjacent cell. Alignment pins 252 are located on the shelf 250 and fit into the alignment holes 213 on the aperture plates 210. The alignment holes ensure that the aperture 212 is aligned with the substrate 202 when the substrate and the resonator 200 are inserted into the groove 234 of a housing cell 214.

Figure 7:
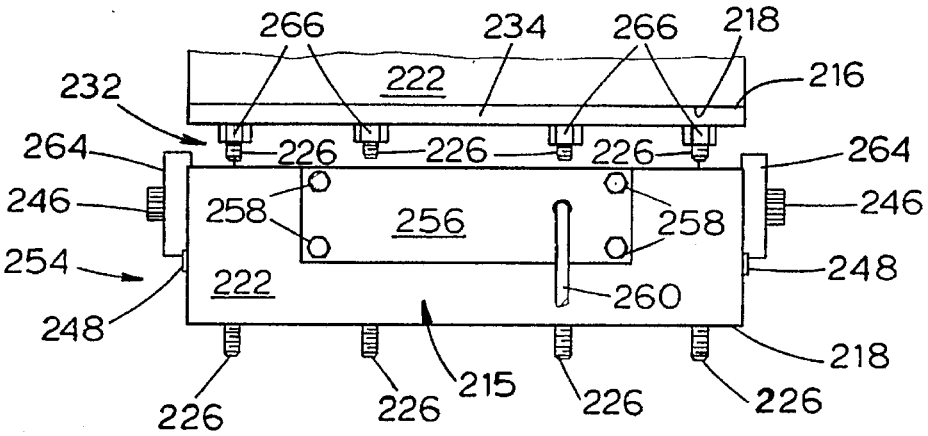
FIG. 7 is a side elevational view of a housing end cell of a filter of the present invention.
Figure 8:
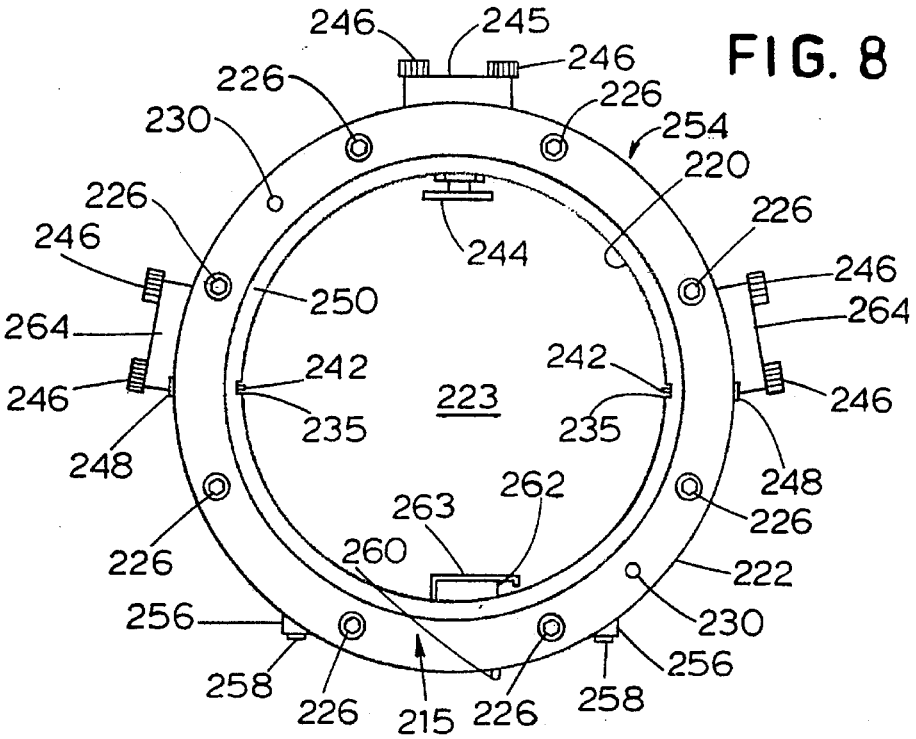
FIG. 8 is a bottom view of the housing cell of FIG. 7.

Referring now to FIGS. 7 and 8, a housing end cell indicated generally at 254 is adapted to be used as the first or last cell of a filter housing. The end cell 254 is similar to the interior cell 214 but has a number of modifications described below to adapt it for use on either end of a filter housing. Each element of the end cell 254 which is identical to an element of the interior cell 214 has been given the same reference numeral.

The end cell 254 has a bushing 256 (best seen in FIG. 7), made of a conductive material, preferably copper, secured by bolts 258 to the end cell. On the exterior of the bushing 256 is a coaxial tubular connector 260 which carries an electromagnetic signal to or from the filter. The exterior of the connector 260 is in electric contact with the bushing 256 while an interior lead 262 of the connector 260 is insulated from and passages through the bushing 260. After passing through the bushing 256, the interior lead 262 contacts a loop 263 (FIG. 8) near one end of the loop. The other end of the loop 263 is connected to the inside of the bushing 256. The signal passing through the loop 263 is thereby coupled to the resonator 200. By withdrawing the bolts 258, the bushing 256 can be removed to provide easy adjustment of the loop 263.

In addition to the cap 245, the end cell 254 has caps 264 attached to the outer surface 222 by the bolts 246 and indium solder. The caps 264 are used to cover openings which have been placed in cell wall 215 so that other devices may be connected to or pass through the end cell 254. For instance, it may be desirable to pressurize the interior of the filter housing with helium to increase thermal conductivity to the resonator while preventing the cooling fluid, such as liquid nitrogen, from entering the cavity 223 of the filter housing and interfering with the electrical properties of the resonators 200. A helium coupling might therefore pass through the cell wall 215 in the area of the caps 264. A variety of monitoring devices may also be inserted into the cell through the openings covered by the caps 264 to measure filter performance or operating characteristics.

Figure 9:
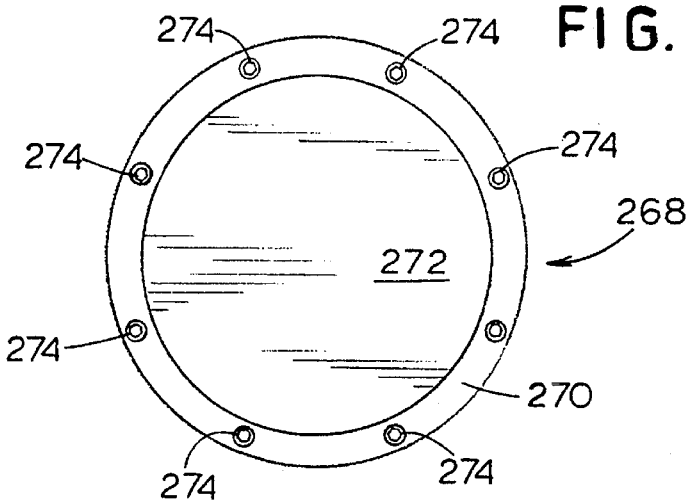
FIG. 9 is a top view of a housing end plate of an embodiment of a filter of the present invention.

One side of the end cell 254 will be attached to another cell in the manner described above for the interior cell 214. The upper surface 216 of the end cell 254 is attached to the lower surface 218 of another cell (FIG. 7) by the bolts 226 which pass through the rim 234 and are fastened with nuts 266. The lower surface 218 of the end cell 254 in FIG. 7 is not attached to another cell but rather to an end plate indicated generally at 268 (FIG. 9). The end plate 268 has an outer rim 270 which surrounds an interior section 272. Openings 274 are spaced around the outer rim 270 so that the bolts 226 may pass through those openings for attachment by nuts (not depicted). The interior section 272 of the end plate 268 is offset from the outer rim 270 so that the edge of the interior section 272 will contact the shelf 250 (FIG. 8) of the end cell 254 while the outer rim 270 contacts the lower surface 218. At the other end of the filter housing, a second end plate 268 attaches to the upper surface 216 of an end cell located at the end of the filter housing in a manner similar to the attachment of the end plate 268 to the lower surface 218. Similarly, the second end cell will attach at its lower surface 218 to the upper surface 216 of an adjacent cell. Either end plate may be sealed to the end cell using indium solder.

Figure 11:
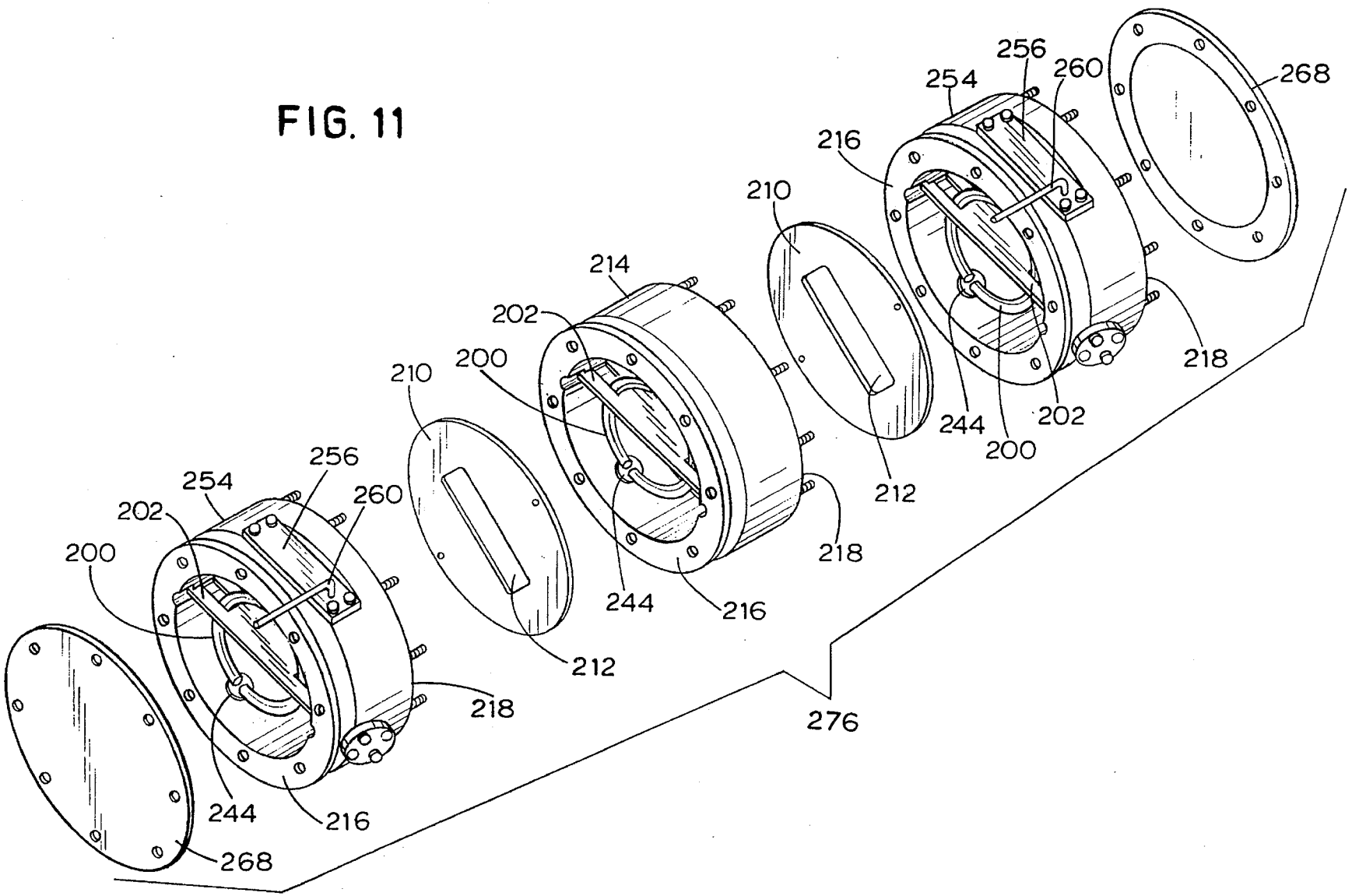
FIG. 11 is an exploded view of a filter of the present invention.

Referring now to FIG. 11, a modular filter 276 has a housing made of three cells: the interior cell 214 and two end cells 254. The interior cell 214 and each end cell 254 contains a resonator 200 secured to the cell by a substrate 202. When the modular filter is assembled, an electromagnetic signal is transmitted through the coaxial connector 260 into the bushing 256 for coupling to a resonator contained in one of the end cells 254. The signal then passes through the coupling plate 210 to the resonator 200 in the interior cell 214. The signal continues through the second coupling plate 210 to the resonator 200 in the end cell 254 and out through the other coaxial connector 260. Once the filter 276 has been assembled, the tuning disks 244 are adjusted to tune the resonators to the desired filtering characteristics as is well known in the art. If the resonators 200 contain superconducting material, the filter 276 must be immersed in a super-cooling fluid such as liquid nitrogen after all adjustments have been made. Instead of using a super-cooling fluid, the filter may be placed in a cryorefrigerator such as the CryoTiger® manufactured by APD Cryogenics of Allentown, Pa. The filter 276 is designed to be easily sealed so that no super-cooling fluid enters the interior of the filter while still permitting detachment of the cells for service or addition of cells. The cells, coupling plates and end plates of the filter 276 may be made of a variety of electrically conducting materials, but preferably are made of silver-plated aluminum.

Although only three cells are shown for modular filter 276, more cells may be added to modify the filter characteristics as desired, as is well known in the art. Adding cells is accomplished by inserting additional interior cells 214 having resonators 200 into the middle of the filter once cells have been separated from each other. Superconducting resonators which may be used in the modular filter 276 have very low insertion loss and therefore a number of resonators can be used in a given filter without unacceptably weakening the output signal. One significant advantage of the modular housing 276 is the ease with which additional resonators can be added to obtain the desired filter characteristics.

The filter characteristics of filters constructed in accordance with the principles of the present invention can be designed by procedures well known to those skilled in the art. See, for example, A. I. Azverev, "Handbook of Filter Synthesis," J. Wiley and Sons, Inc., New York, 1967. Briefly, the designer selects the desired filter response and filter type, and then determines the required number of resonators with the aid of known nomographs. Using known tables for the (normalized) conventional parameters k and q, the required values of quality factor Q and coupling coefficient K can be determined. Using a known de-tuning and adjusting procedure, the end resonators are set to the required Qs. From data listing K as a function of distance between resonators, the spacing between the resonators that will yield the required K is determined.

Figure 10:
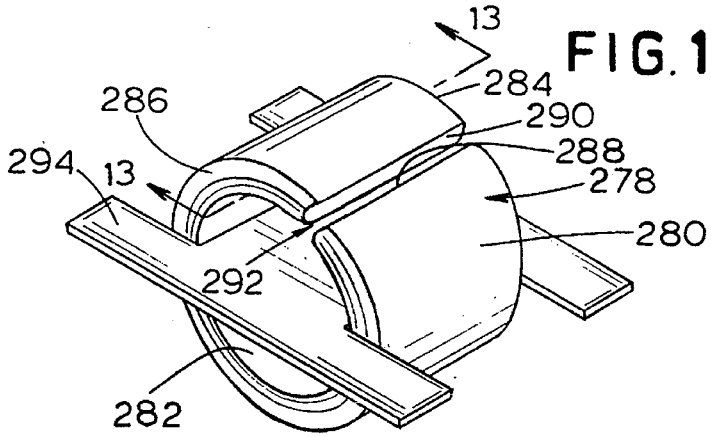
FIG. 10 is an embodiment of a resonator and substrate used in a filter of the present invention.

Referring to FIG. 10, another resonator 278 has a generally cylindrical shape with an outer surface 280, an inner surface 282, an upper surface 284 and a lower surface 286, which together form the exterior surface of the resonator 278. An end face 288 and an end face 290 oppose each other to form a gap 292. The resonator is attached to a substrate 294 similar to the substrate 202 used with the resonator 200. Like the resonator 200, the resonator 278 has a rounded exterior surface without any corners, and therefore has an oblong shaped cross-section as shown in FIG. 13. The resonator 278 will also have many of the coating and uniform electric field advantages of the resonator 200. The resonator 278 is larger than the resonator 200 so that the housing for the resonator 278 must be larger than the housing for the resonator 200, but may be identical in all other respects.

The foregoing detailed description has been given for clearness of understanding only, and no unnecessary limitations should be understood therefrom, as modifications would be obvious to those skilled in the art.

We claim:

1. A filter comprising:

a housing having a cavity therein;

a cylindrically curved split ring resonator located in the cavity of the housing, the resonator having an outer surface, a first face and a second face, wherein the resonator has a cross-section generally perpendicular to the curve of the resonator, the cross-section is defined by a planar figure closed by the outer surface of the resonator, the planar figure is free of corners and the first and second faces oppose each other to define a gap therebetween, wherein the freedom from corners in the cross-section minimizes electromagnetic discontinuities and means for coupling electromagnetic energy through the housing to the resonator, wherein the resonator comprises a high-temperature superconducting material.

2. A filter as recited in claim 1 wherein the cross-section is circular.

3. A filter as recited in claim 1 wherein the cross-section is oblong.

4. A filter as recited in claim 1 wherein the housing comprises aluminum with a silver coating.

5. A filter as recited in claim 1 wherein the superconducting material comprises a film of $YBa_2Cu_3O_7$.

6. A filter as recited in claim 1 further comprising:

a substrate which holds the resonator;

a groove on an inner surface of the housing which receives the substrate therein;

a pin at a first end of the groove for locating the substrate; and a spring at a second end of the groove for retaining the substrate while allowing for movement of the substrate with respect to the groove due to expansion or contraction of the housing and substrate due to temperature changes;

wherein the substrate secures the resonator to the housing.

7. A filter as recited in claim 1 further comprising a thermally conductive gas disposed within the cavity.

8. A filter as recited in claim 1 further including a substrate comprised of a dielectric material which holds the resonator in the housing.

9. A filter comprising:

a housing comprising a plurality of housing cells; and a plurality of cylindrically curved split ring resonators, wherein at least one resonator is located in each of the housing cells, each resonator respectively has an outer surface, a first face and a second face, each resonator respectively has a cross-section generally perpendicular to the curve of the resonator, each cross-section in defined by a respective planar figure closed by the outer surface of the corresponding resonator, each planar figure is free of corners, the respective first and second faces oppose each other to define a corresponding gap therebetween and each resonator respectively comprises a high-temperature superconducting material;

means for coupling electromagnetic energy through the housing to the at least one resonator; and means for coupling electromagnetic energy from each resonator to an adjacent resonator.

10. A filter as recited in claim 9 comprising a first end cell and a second end cell wherein the first end cell contains the means for coupling electromagnetic energy through the housing to the at least one resonator and the second end cell contains a means for coupling electromagnetic energy from a second resonator through the housing.

11. A filter as recited in claim 9 wherein each cell comprises a respective cell wall, having an upper surface and a lower surface, and includes respective means adjacent the upper surface and the lower surface for releasably attaching the corresponding cell to adjacent cells or to end plates.

12. A filter as recited claim 11 wherein the plurality of cells comprises a first end cell and a second end cell, a first end plate being fastened to the upper surface of the first end cell, and a second end plate being fastened to the lower surface of the second end cell.

13. A filter as recited in claim 9 wherein the means for coupling electromagnetic energy from each resonator to an adjacent resonator comprises a respective plate having a corresponding aperture therein.

14. A filter as recited in claim 13 wherein a respective surface of a corresponding housing cell has a respective alignment pin, the respective plate has a corresponding alignment hole, and the respective alignment pin engages the corresponding alignment hole to fix the respective plate in a desired position on the corresponding cell.

15. A resonant element comprising:

a split ring having an outer surface and end faces wherein the element has the shape of a cylinder having said end faces located at opposing ends thereof, and where the cylinder is curved upon itself to define a ring where the end faces oppose each other to define a gap therebetween;

wherein the resonator has a cross-section generally perpendicular to the curve of the cylinder, the cross-section is defined by a planar figure closed by the outer surface of the resonator and the planar figure is free of corners, wherein the freedom from corners in the cross-section minimizes electromagnetic discontinuities; and wherein the ring comprises a high temperature superconducting material.

16. The resonant element of claim 15 wherein the cross-section is oblong.

17. The resonant element of claim 15 wherein the superconductive material is $YBa_2Cu_3O_7$.

18. The resonant element of claim 15 wherein the cross-section is a circle.

19. A filter comprising:

a housing having a cavity therein;

a resonator comprised of superconducting material located in the housing; and a thermally conductive gas disposed within the cavity.

20. A filter as recited in claim 19 wherein the housing is cooled by a cryorefrigerator.

21. A filter as recited in claim 19 wherein the housing is located in a super-cooling fluid, and the gas disposed within the cavity is pressurized to prevent the super-cooling fluid from entering the cavity.

22. A filter as recited in claim 21 wherein the thermally conductive gas is helium.

23. A device employing superconductivity comprising:

a housing defining a cavity in the housing;

a superconducting element disposed within the cavity; and a thermally conductive gas disposed within the cavity in thermal contact with the element;

wherein the gas conducts heat away from the element.

24. The device of claim 23 wherein the housing is cooled and the gas conducts heat from the element to the housing.

25. The device of claim 24 wherein the housing is located in a super-cooled liquid and the gas in the cavity is pressurized to inhibit flow of the liquid into the cavity.

* * * * *

UNITED STATES PATENT AND TRADEMARK OFFICE

CERTIFICATE OF CORRECTION

PATENT NO. : 5,616,540

DATED : April 1, 1997

INVENTOR(S) : Lithgow et al.

It is certified that error appears in the above-identified patent and that said Letters Patent is hereby corrected as shown below:

Column 7, line 35 (Claim 1), please insert --the-- between the words "and" and "second."

Column 8, line 8 (Claim 9), please delete the word [in] and insert the word --is-- therefor.

Signed and Sealed this

Twenty-first Day of October 1997

*Attest:*

*Attesting Officer*

BRUCE LEHMAN

*Commissioner of Patents and Trademarks*